US007748711B2

(12) United States Patent
Kawashima

(10) Patent No.: US 7,748,711 B2
(45) Date of Patent: Jul. 6, 2010

(54) IMAGE FORMING APPARATUS

(75) Inventor: Tetsuro Kawashima, Osaka (JP)

(73) Assignee: Kyocera Mita Corporation (JP)

( * ) Notice: Subject to any disclaimer, the term of this patent is extended or adjusted under 35 U.S.C. 154(b) by 10 days.

(21) Appl. No.: 12/260,539

(22) Filed: Oct. 29, 2008

(65) Prior Publication Data

US 2009/0108518 A1 Apr. 30, 2009

(30) Foreign Application Priority Data

Oct. 31, 2007 (JP) ..... 2007-283934
Oct. 31, 2007 (JP) ..... 2007-284214

(51) Int. Cl.
*B65H 39/10* (2006.01)

(52) U.S. Cl. ..... 271/291; 271/301; 271/65; 271/186

(58) Field of Classification Search ..... 271/291, 271/301, 65, 186; 399/401, 364, 373, 374
See application file for complete search history.

(56) References Cited

U.S. PATENT DOCUMENTS 6,926,272 B2 * 8/2005 Carter et al. ..... 271/258.01
2003/0209852 A1 * 11/2003 Choi ..... 271/291
2004/0165921 A1 * 8/2004 Miura ..... 399/401
2005/0157357 A1 * 7/2005 Yamanaka ..... 358/498
2005/0214050 A1 * 9/2005 Carter et al. ..... 399/401

FOREIGN PATENT DOCUMENTS

JP 2006062855 3/2006

* cited by examiner

*Primary Examiner*—David H Bollinger
(74) *Attorney, Agent, or Firm*—Gerald E. Hespos; Michael J. Porco

(57) ABSTRACT

An image forming apparatus includes a first sheet conveying passage that conveys a sheet through an image forming section. A sheet-discharging roller is on an outlet side of the first sheet conveying passage and can rotate in opposite directions. A second sheet conveying passage has an inlet connected to the first sheet conveying passage downstream from the image forming section and an outlet connected to the first sheet conveying passage upstream from the image forming section. A controller controls double-sided printing by causing the sheet-discharging roller to rotate forward to advance the sheet outside the sheet-discharging roller, and then to rotate in reverse to execute a switchback for transporting the sheet to the inlet side of the second sheet conveying passage and then to return the sheet to the upstream of the image forming section. An assisting mechanism adjusts a posture of the sheet to assist the switchback.

20 Claims, 9 Drawing Sheets

IMAGE FORMING APPARATUS

BACKGROUND OF THE INVENTION

1. Field of the Invention

The present invention relates to an image forming apparatus capable of forming images on opposite sides of a sheet.

2. Description of the Related Art

An image forming apparatus which has a function of performing image forming on opposite sides of a sheet has been widely used. In such a double-sided image forming process of the apparatus, an image is formed on a front side of a sheet, and then image forming on a back side of the sheet is conducted upon reversing back the sheet by a switch back conveyance so that the sheet is reversed back to an image forming section.

The double-sided image forming will be specifically described with reference to FIG. 9. Firstly, a sheet P0 which is accommodated in a sheet-feeding cassette 101 is conveyed to a transferring section 102 through a main conveying passage 100A on an upstream. Then, an image forming processing is applied to a front side of the sheet P0. After that, the sheet P0 is conveyed to a fixing section 103 through an intermediate main conveying passage 100B, and an image is fixed on the sheet P0. Then, the sheet P0 is conveyed to a sheet discharging section 104 having sheet-discharging rollers 104*a* and 104*b* through a main conveying passage 100C on a downstream. Until a tailing end of the sheet P0 gets out of a branching lever 105, a part of a leading end of the sheet P0 projects outward from the sheet-discharging rollers 104*a* and 104*b*. After that, reverse rotations of the sheet-discharging rollers 104*a* and 104*b* perform switching back conveyance to the reversing conveying passage 100D in which the former tailing end is turned as a leading end of the sheet P0. Accordingly, the sheet P0 in a state of being reversed front and back is returned back to the upstream main conveying passage 100A again. Then, the sheet P0 passes through the transferring section 102 and the fixing section 103 so that image forming is performed on the back side of the sheet P0, and the sheet P to which the double-sided printing is performed is discharged to outside from the sheet discharging section 104 (for example, refer to Japanese Patent Unexamined Publication No. 2006-62855).

In the switch-back conveyance, it is necessary that the reverse rotations of the sheet-discharging rollers 104*a* and 104*b* makes the leading end (tailing end before switching back) of the sheet P0 assuredly move toward the inlet side of the reversing conveying passage 100D. However, at the time of switching back, there has been a problem that the leading end of the sheet P0 hangs down and is oriented toward the main conveying passage 100B, not the conveying passage 100D, so that the sheet P0 reversely moves to the discharging section 104, and the sheet P0 jammed.

SUMMARY OF THE INVENTION

An object of the present invention is to prevent hanging of a sheet so as to smoothly perform a switch-back conveyance.

An image forming apparatus in accordance with an aspect of the present invention which accomplishes the object includes: an image forming section that forms an image onto a sheet; a first sheet conveying passage that conveys the sheet through the image forming section; a sheet-discharging roller provided on an outlet side of the first sheet conveying passage and capable of rotating in both normal and reverse directions; a second sheet conveying passage having an inlet side connected to the first sheet conveying passage on a downstream side in a sheet-conveying direction from the image forming section and having an outlet side connected to the first sheet conveying passage on an upstream side in the sheet-conveying direction from the image forming section; a controller that controls, at a timing of executing a double-sided printing, the sheet-discharging roller to rotate in normal directions to convey the sheet in a forward direction so as to put out a part of the sheet to outside from the sheet-discharging roller, and then to rotate in reverse directions to execute a switch back conveyance by which the sheet is transported to an inlet side of the second sheet conveying passage in order to return the sheet back to the upstream side of the image forming section; and an assisting mechanism that assists the switch back conveyance by adjusting a posture of the sheet.

These and other objects, features and advantages of the present invention will become more apparent upon reading of the following detailed description along with the accompanied drawings.

DESCRIPTION OF THE PREFERRED EMBODIMENTS

Hereinafter, embodiments of the present invention will be described in detailed with reference to the drawings. In the present embodiments, the case where the image forming apparatus is a copying machine will be described. However, the present invention is not limited to this. For example, the image forming apparatus may be a printer, a facsimile machine, or the like.

First Embodiment

Figure 1:
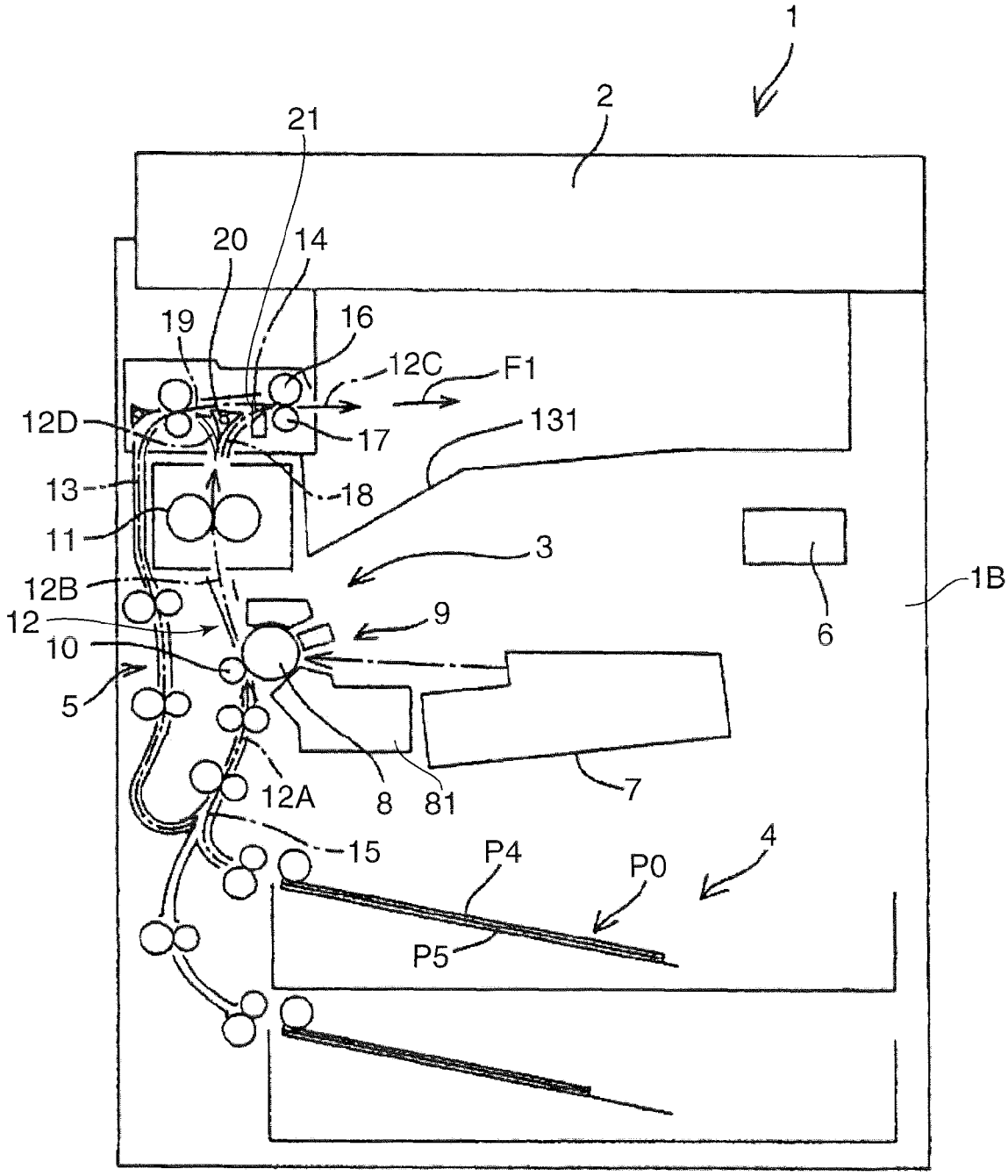
FIG. 1 is a front sectional view which shows a schematic configuration of an image forming apparatus in accordance with embodiments of the present invention.

FIG. 1 is a front sectional view showing a schematic configuration of an image forming apparatus 1 in accordance with an embodiment of the present invention. The image forming apparatus 1 includes an apparatus main body 1B and a reading section 2 which is arranged on top of the apparatus main body 1B and optically reads a document image to be copied.

The apparatus main body 1B accommodates an image forming section 3 for forming an image onto a sheet P0 in accordance with image data of a document image which is obtained from the reading section 2, a sheet-supplying section 4 for supplying a sheet P0 to the image forming section 3, a sheet-conveying section 5 for conveying the sheet P0 to outside from the sheet-supplying section 4 through the image forming section 3, and a controller 6 that executes controlling operations of the above-described sections of the image forming apparatus 1. Between the reading section 2 and the apparatus main body 1B, there is provided a sheet-discharging tray 131 of an in-body sheet discharging type.

The reading section 2 includes a light source for irradiating light to a document, a moving frame member which moves while bearing the light source, an imaging device, and an optical system which leads a reflected light from the document to the imaging device, though none of which are illustrated. Image data obtained by a photoelectric conversion in the imaging device is outputted to the image forming section 3.

The image forming section 3 is arranged in a vertically central portion of the image forming apparatus 1, and includes an exposure device 7, an imaging section 9, a transferring section 10, and a fixing section 11. The exposure device 7 includes an LED light source and a polygon mirror and generates a light beam in accordance with image data given by the reading section 2. The imaging section 9 includes a photoconductive drum 8 which bears an electrostatic latent image and a toner image and a developing device 81 which supplies toners to the photoconductive drum 8. In an imaging process, a beam light is firstly irradiated from the exposure device 7 onto a peripheral surface of the photoconductive drum 8, so that an electrostatic latent image is formed. After that, toners are supplied from the developing device 81 so that the electrostatic latent image is developed as a toner image. The transferring section 10 includes a transferring roller and transfers the toner image formed on the photoconductive drum 8 onto the sheet P0. The fixing section 11 heats and fixes the transferred toner image onto the sheet P0.

The sheet-conveying section 5 is arranged along one side of the image forming apparatus 1. The sheet-conveying section 5 includes a main conveying passage 12 (first sheet conveying passage) and a reversing conveying passage 13 (second sheet conveying passage), and major portions of those are vertical conveying passages which extend in a vertical direction. The main conveying passage 12 and the reversing conveying passage 13 are connected to each other to form a loop-like shape as a whole. At appropriate portions of the conveying passages 12 and 13, there are arranged a guiding member for guiding conveyance of the sheet P0 (not illustrated) and a conveying roller for conveying the sheet P0 (not illustrated).

The main conveying passage 12 is a conveying passage that conveys the sheet P0 supplied from the sheet-supplying section 4 to the sheet-discharging tray 131 through the image forming section 3, and includes an upstream side conveying passage 12A and an intermediate conveying passage 12B, which are vertical conveying passages extending in the vertical direction, a downstream side conveying passage 12C which is a curved conveying passage whose sheet-conveying direction changes from the vertical direction to the horizontal direction at a substantially right angle, and a branching conveying passage 12D. In FIG. 1, the conveying passages 12A-12D are shown by arrows indicating conveying directions of the conveying passages 12A-12D.

The upstream side conveying passage 12A is connected at its bottom end to the sheet-supplying section 4 and conveys the sheet P0 upward from the sheet-supplying section 4 to the image forming section 3. The middle conveying passage 12B conveys the sheet P0 upward in the image forming section 3, in other words, through the transferring section 10 and the fixing section 11. The downstream side conveying passage 12C is a conveying passage which extends from the image forming section 3 to outside (sheet-discharging tray 131) and changes the conveying direction of the sheet P0 from the upward direction to the horizontal direction and conveys the sheet P0. The sheet-discharging tray 131 faces the end portion 14 of the downstream side conveying passage 12C and is provided between the apparatus main body 1B and the reading section 2 and is open to outside.

At the end portion 14 of the downstream side conveying passage 12C (outlet side of the first sheet conveying passage), there are arranged the first and second sheet-discharging rollers 16 and 17. The first and second sheet-discharging rollers 16 and 17 rotate in normal directions (the normal directions are indicated by arrows in FIG. 2), so as to send the sheet P0, which is conveyed in the downstream side conveying passage 12C and is formed with an image, toward the sheet-discharging tray 131 and discharge the same.

The reversing conveying passage 13 has an inlet side which is communicated between an upstream side in the sheet conveying direction from the end portion 14 of the downstream side conveying passage 12C and a downstream side from the fixing section 11 (image forming section 3), and has an outlet side which is communicated to an upstream side from the transferring section 10 (image forming section 3) of the upstream side conveying passage 12A. The reversing conveying passage 13 is a vertical conveying passage which mainly extends in the vertical direction, but it curves in a U-shape before a merging portion 15 between the outlet side and the upstream side conveying passage 12A. At a connecting portion between the inlet side of the reversing conveying passage 13 and the downstream side conveying passage 12C, there is provided with a branching space 18 which has a substantially triangular shape in a front cross-sectional view. In the branching space 18, a branching lever 20 for switching the conveying direction of the sheet P0 is arranged.

Figure 2:
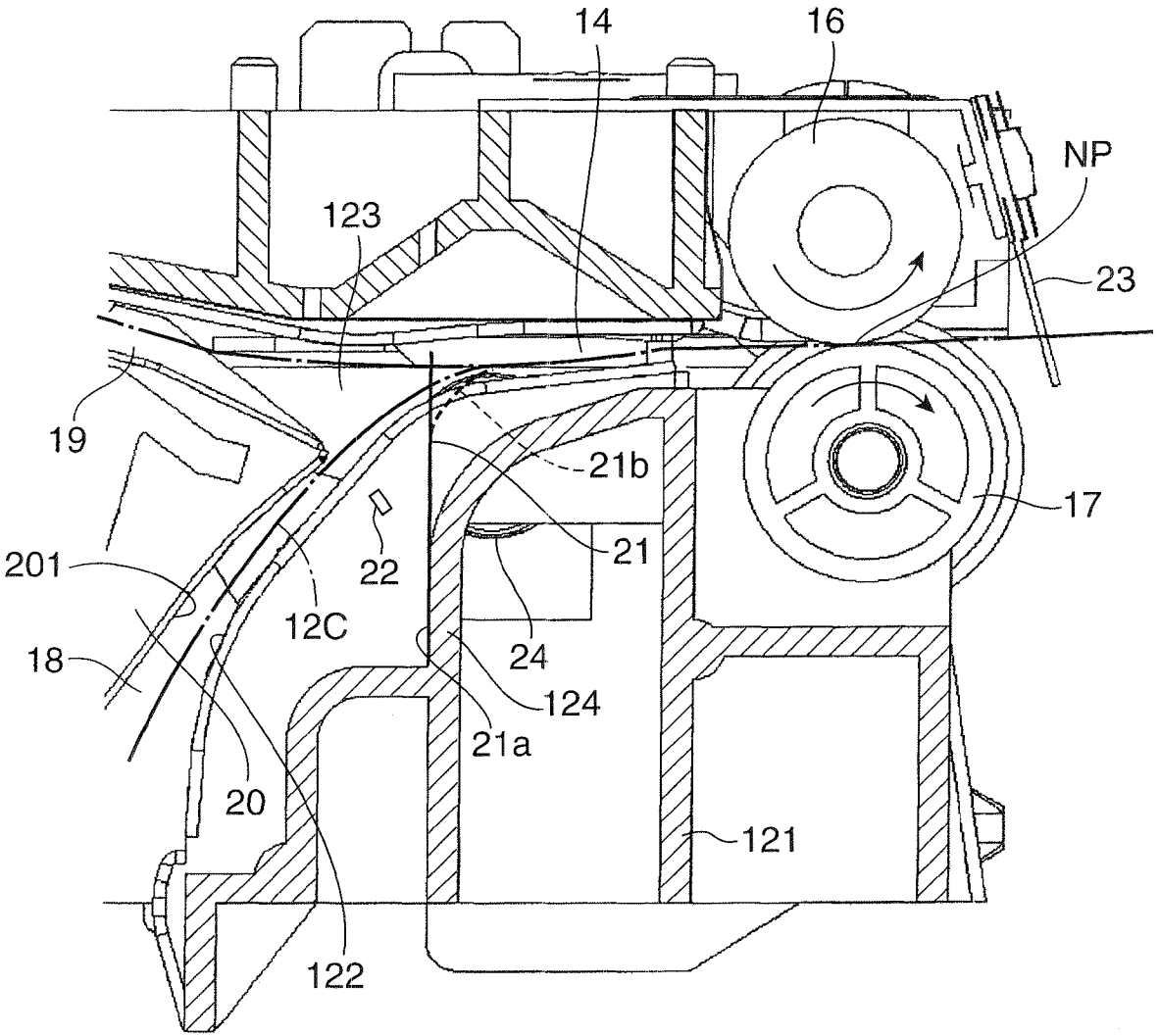
FIG. 2 is a sectional view of a peripheral portion of sheet-discharging rollers in accordance with a first embodiment of the present invention.

As shown in FIG. 2, an inlet portion 19 of the reversing conveying passage 13 faces an upper portion of the branching space 18 and is positioned in the horizontal direction at substantially the same height with respect to a sheet nip portion NP between the sheet-discharging rollers 16 and 17. Upper side surface of the downstream side conveying passage 12C are respectively shaped by one side wall 201 of the branching lever 20 and a guide surface 122 of the compartment member 121. Thus, the end portion 14 of the downstream side conveying passage 12C reaches an upper portion of the branching space 18. Between the end portion 14 and the inlet portion 19, there is a space as a posture changing passage 123, which will be described below.

The reversing conveying passage 13 is provided to convey the sheet P0, on which an image is formed once on one side through the main conveying passage 12, to the merging portion 15 in a state where front and back sides of the sheet P0 is reversed in a case where images are to be formed on opposite sides of the sheet P0. Specifically, the sheet P0 printed on one side is once conveyed in the forward direction (shown as a conveying direction F1 in FIG. 1) by normal rotations of the first and second sheet-discharging rollers 16 and 17 through the downstream side conveying passage 12C. When the tailing end of the sheet P0 in the conveying direction of the downstream side conveying passage 12C reaches a predetermined position at which the tailing end does not get off the nip portion NP of the sheet-discharging rollers 16 and 17, the rotation of the sheet-discharging rollers 16 and 17 is halted. In this state, the tailing end of the sheet P0 remains in the apparatus main body 1B, so that the leading end projects toward the sheet-discharging tray 131.

After that, the first and second sheet-discharging rollers 16 and 17 rotate in the reverse directions, so that the sheet P0 is switched back in which the former tailing end at the time of the forward conveyance is switched to be the leading end. This switching back conveyance transports the sheet P0 to the inlet portion 19 of the reversing conveying passage 13, and an unillustrated conveying roller provided in the reversing conveying passage 13 conveys the sheet P0 to the merging portion 15.

The branching conveying passage 12D is a conveying passage which is formed between a compartment member and the branching lever 20 and is used for the case of conveying the sheet P0 discharged from the fixing section 11, not toward the side of the sheet-discharging tray 131 but toward the left side wall surface of the apparatus main body 1B. The branching conveying passage 12D is used, for example, in a state where an option tray is mounted on the left side wall surface and the sheet P0 is needed to be discharged to the option tray. The branching lever 20 switches the conveying direction of the sheet P0, which is sent out from the fixing section 11, to one of a direction along the downstream side conveying passage 12C and a direction along the branching conveying passage 12D.

The controller 6 is provided with a microcomputer as a control center and controls operations of respective sections or portions of the image forming apparatus based on a prestored program in accordance with an input signal from an unillustrated operating section. The image forming apparatus 1 in accordance with the present embodiment has a double-sided image forming function of forming images on opposite sides of the sheet P0. When a signal of instructing the double-sided printing processing is given from a user through the operating section, the controller 6 controls rotations of the sheet-discharging rollers 16 and 17 as described above to conduct the conveyance in the forward direction and the switching back, so that the sheet P0 returns back to the upstream side of the image forming section 3.

Specifically, the controller 6 executes the switch back conveyance in accordance with the following steps at the time of performing the double-sided image forming. Firstly, the sheet P0 is conveyed along the conveying passages 12A, 12B, and 12C of the main conveying passage 12 to pass through the image forming section 3. During that time, a toner image is transferred onto a front side P4 of the sheet P0 in the transferring section, and then the toner image is fixed on the front side P4 in the fixing section 11. The sheet P0 having an image formed on the front side P4 is conveyed through the downstream side conveying passage 12C. However, the controller 6 controls the sheet-discharging rollers 16 and 17 to be rotated in the normal directions to convey the sheet P0 in the forward direction, so that a part of the sheet P0 is put out to outside from the sheet-discharging rollers 16 and 17.

After that, the controller 6 controls the sheet-discharging rollers 16 and 17 to rotate in the reverse directions in order to switch back the sheet P0 to the inlet portion 19 of the reversing conveying passage 13, and successively returns the sheet P0 back to the merging portion 15 as an upstream side of the image forming section 3. Accordingly, the sheet P0 is conveyed again through the main conveying passage 12. However, at this time, the sheet P0 is reversed front and back with respect to the time of forming an image onto the front side P4. The controller 6 executes the control of allowing the sheet P0 be re-conveyed through the main conveying passage 12 and allowing the image forming section 3 to form an image onto a back side P5. Then, the controller 6 controls the sheet-discharging rollers 16 and 17 to make a normal rotation again so as to completely discharge the sheet P0, which has images formed on opposite sides, to the sheet-discharging tray 131.

Figure 3:
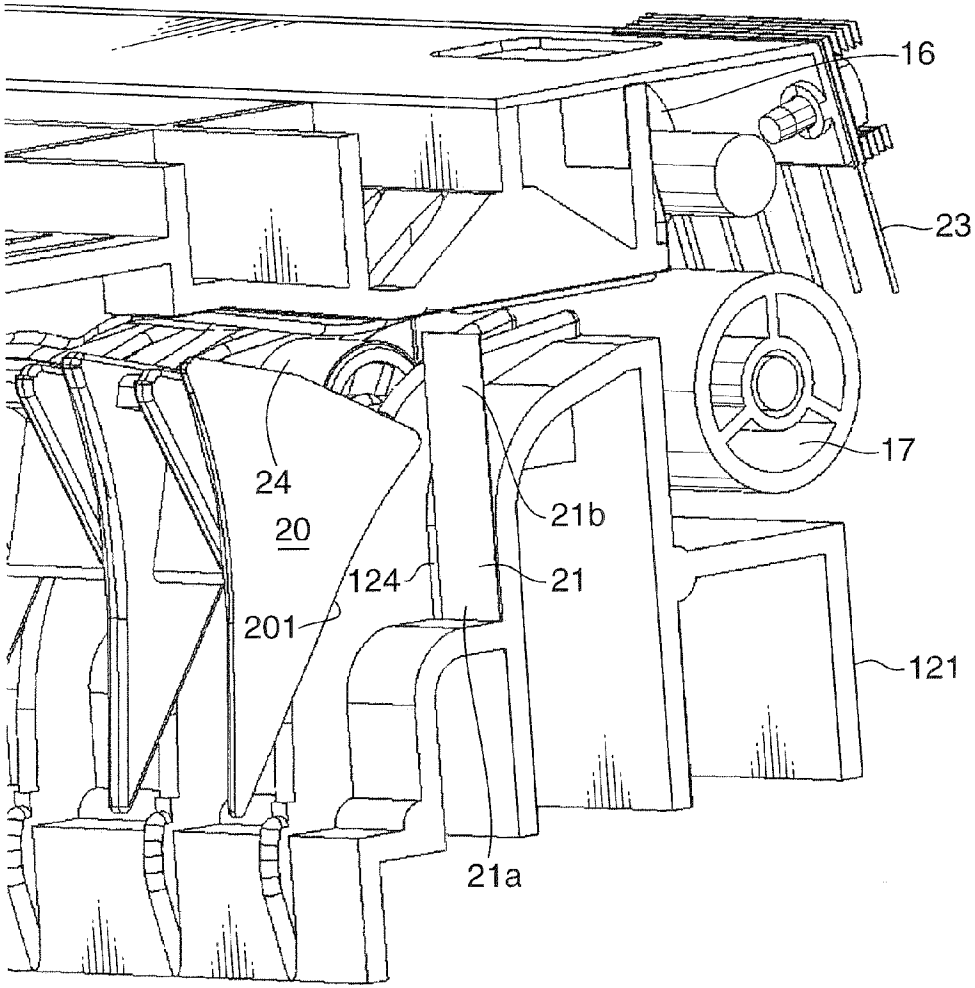
FIG. 3 is a perspective view of the part shown in FIG. 2.
Figure 4:
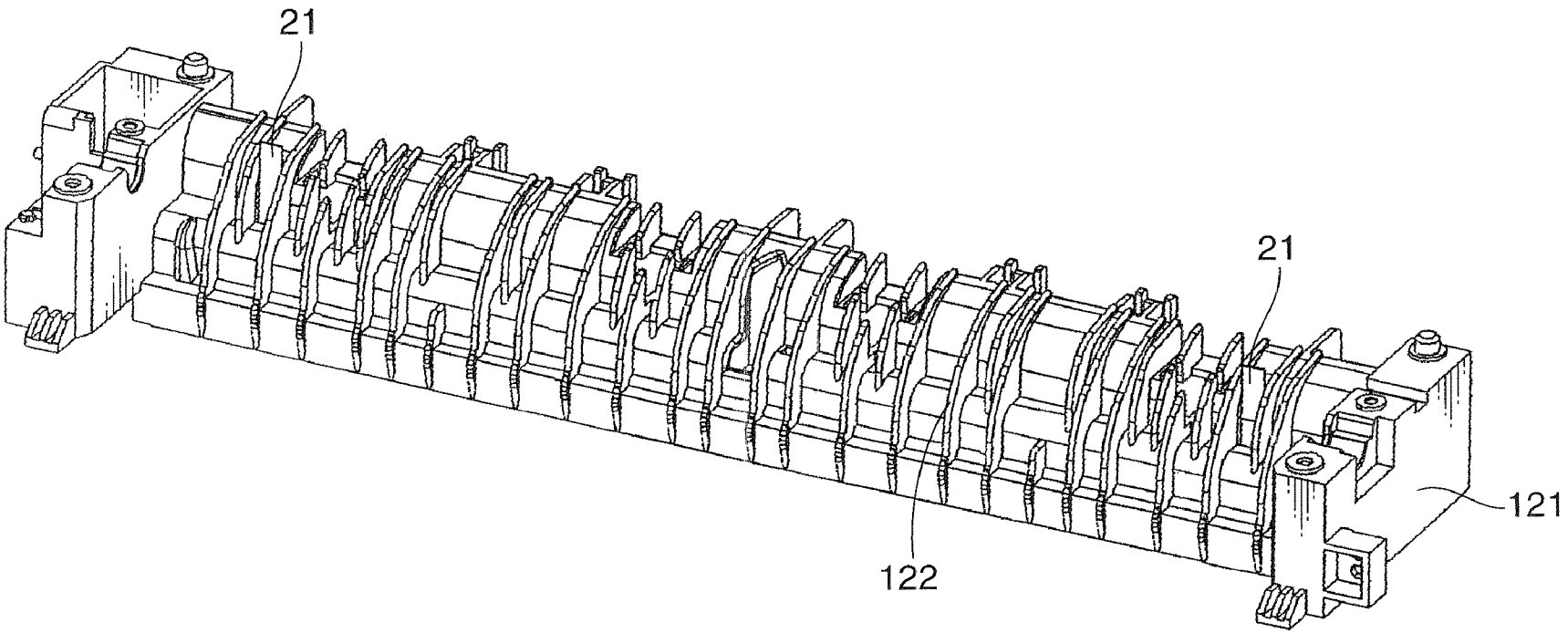
FIG. 4 is a perspective view of a compartment member having a guide surface which constitutes a lower side of a curved conveying passage.

Next, a peripheral portion of the sheet-discharging rollers 16 and 17 will be described in detail. FIG. 2 is a sectional view showing a peripheral portion of the sheet-discharging rollers 16 and 17. FIG. 3 is a perspective view of the part shown in FIG. 2. FIG. 4 is a perspective view of the compartment member 121. As configurations other than those described above, the image forming apparatus 1 includes a first flexible member 21 (assisting mechanism), a tailing end detection sensor 22, a charge-removing brush 23, and a conveying roller 24.

The first flexible member 21 is a member which is arranged on an upstream side of the sheet-discharging rollers 16 and 17, and assists the switching back by adjusting a posture of the sheet P0 at the time of performing the switching back. The first flexible member 21 is provided in a pair respectively on opposite end portions of the downstream side conveying passage 12C (or the curved conveying passage) in the width-directions.

As described above, the downstream side conveying passage 12C is put out the sheet P0 in a state of being curved to the sheet-discharging rollers 16 and 17 arranged on the side of the end portion 14. When the leading end of the sheet P0 in the forward direction is nipped by the sheet-discharging roller 16 and 17 and conveyed toward the sheet-discharging tray 131, the tailing end of the sheet P0 reaches the posture changing passage 123 passing through the one side wall 201 of the branching lever 20. At this time, the sheet P0 is supported by the first flexible member 21 so that it may be changed to a posture of a flat state extending substantially straightly from a bent state. Similarly, at the time of switching back, the flat state is maintained by the support of the first flexible member 21.

The tailing end detection sensor 22 is a sensor which is arranged at an appropriate portion of the compartment member 121 and optically detects entrance of a tailing end of the sheet P0 in the forward conveyance into the posture changing passage 123. The tailing end detection sensor 22 is, for example, of a reflection type, and does not catch a reflected light from the sheet P0 when the tailing end of the sheet P0 passes, so that the tailing end of the sheet P0 is detected. The detection signal is given to the controller 6, and the controller 6 temporarily stops the normal rotation of the sheet-discharging rollers 16 and 17 in accordance with the signal input. At this time, the sheet P0 stops in a state where the tailing end gets out of the one side wall 201 of the branching lever 20 and enters the posture changing passage 123. After that, the controller 6 controls the sheet-discharging rollers 16 and 17 to rotate in the reverse directions, then executes the switching back conveyance of the sheet P0, and move the sheet P0 toward the inlet portion 19 of the reversing conveying passage 13 while making the former tailing end in the forward direction conveyance to be a new leading end.

The charge-removing brush 23 (charge-removing member) is a conductive member which is comb-like and flexible and arranged on a downstream side of the sheet-discharging rollers 16 and 17. The charge-removing brush 23 has an earth electric potential and grounds the static electricity with which the sheet P0 is charged. The conveying roller 24 is a roller for easily conveying the sheet P0 through the downstream side conveying passage 12C. The depiction of the conveying roller 24 is omitted in FIG. 4.

The first flexible member 21 will be described further in detail. The first flexible member 21 is provided in a pair on left and right sides between the sheet-discharging rollers 16 and 17 and the branching lever 20. The first flexible member 21 is a stiffened member formed in a rectangular shape and made of resin e.g. PET. Herein, the compartment member 121 has a vertical mounting surface 124 at widthwise opposite end portions. The mounting surface 124 is provided near a central portion in the sheet-conveying direction of the guide surface 122 in a side view, and has a vertical length or height which is half the height of the first flexible member 21 and a width which is slightly wider than the width of the first flexible member 21.

A lower portion 21*a* of the first flexible member 21 is mounted to the mounting surface 124 of the compartment member 121. On the other hand, an upper portion 21*b* of the first flexible member 21 projects upward beyond the guide surface 122 and is arranged so as to extend across the downstream side conveying passage 12C. As a result, the first flexible member 21 comes in contact with an underside surface of the sheet P0, which is conveyed through the downstream side conveying passage 12C, at opposite end portions in the width direction.

A hardness of the first flexible member 21 is set as follows. Firstly, the first flexible member 21 has such a flexibility that, when the sheet P0 which is conveyed through the downstream side conveying passage 12C in a bent state passes, in other words, when the tailing end in the forward conveyance of the sheet P0 does not get out of the one side wall 201 of the branching lever 20, the upper portion 21*b* of the first flexible member 21 is capable of flexibly bending in a proceeding direction of the sheet P0 as indicated by a dot line in FIG. 2. This is for the purpose of not impairing the conveyance of the sheet P0. On the other hand, after the tailing end of the sheet P0 gets out of the one side wall 21 of the branching lever 20 and enters the posture changing passage 123, the first flexible member 21 is capable of returning to be in a vertical posture as indicated by a solid line in FIG. 2. Accordingly, the first flexible member 21 pushes the tailing end side of the sheet P0 upward to retain the sheet P0 in a flat state.

By providing such first flexible member 21, when images are formed on opposite sides of the sheet P0, and the tailing end of the sheet P0 enters the posture changing passage 123 so that the conveyance is stopped, the upper portion 21*b* of the first flexible member 21 comes in contact with the underside surface of the sheet P0 to push up the tailing end of the sheet P0. Accordingly, the sheet P0 is retained in the flat state so that hanging of the tailing end of the sheet P0 is prevented. Thus, at the time of switching back, the sheet P0 can assuredly be returned back to the inlet portion 19 of the reversing conveying passage 13, so that catching of the sheet P0 is prevented.

Further, although the first flexible member 21 still projects to a conveyance area (downstream side conveying passage 12C) of the sheet P0 when the sheet P0 is moved toward the sheet-discharging roller 16 and 17 through the main conveying passage 12, the sheet P0 further conveyed through the downstream side conveying passage 12C makes the first flexible member 21 be flexibly bent from the standing state indicated by the line shown in FIG. 2 to the bent state indicated by the broken line. Therefore, the conveyance of the sheet P0 is allowed and not interfered. The first flexible member 21 may be the one made by cutting out a commercially available PET sheet, so that the apparatus can be configured in an inexpensive manner.

In the first embodiment described above, the example of arranging a pair of first flexible members 21 on opposite sides in the width direction of the downstream side conveying passage 12C. However, not limited to this, one or more than two first flexible members 21 may be arranged correspondingly to parts at which the tailing end of the sheet P0 hangs.

Further, an example of using an optical sensor of a reflective type as the tailing end detection sensor 22 is shown. Not limited to this, for example, an optical sensor of a transmissive type or a sensor which detects whether a contactor which comes in contact with a sheet with a weak force is in contact or apart in accordance with the change in angle of the contactor.

Second Embodiment

Figure 5:
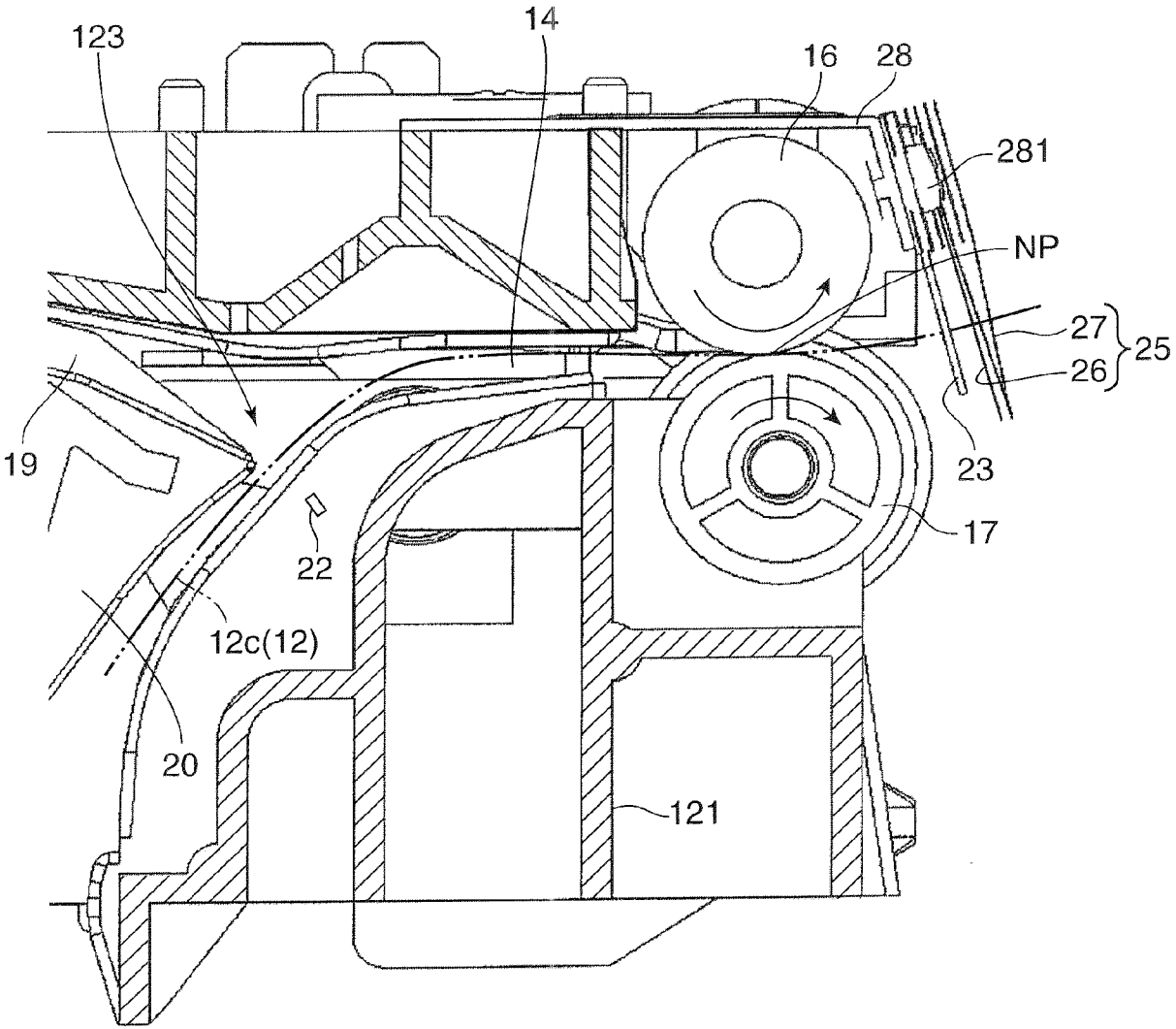
FIG. 5 is a sectional view of a peripheral portion of sheet-discharging rollers in accordance with a second embodiment of the present invention.
Figure 6:
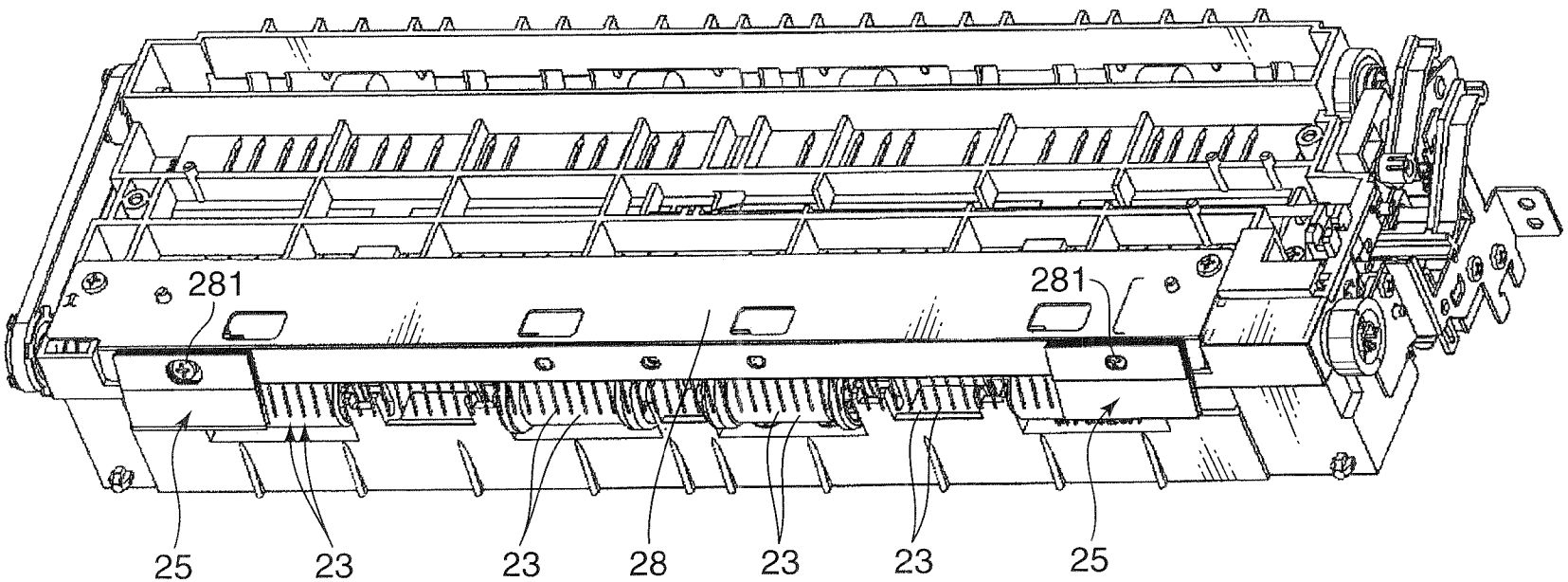
FIG. 6 is a perspective view of a sheet discharging section viewed from a sheet-discharging side.
Figure 7:
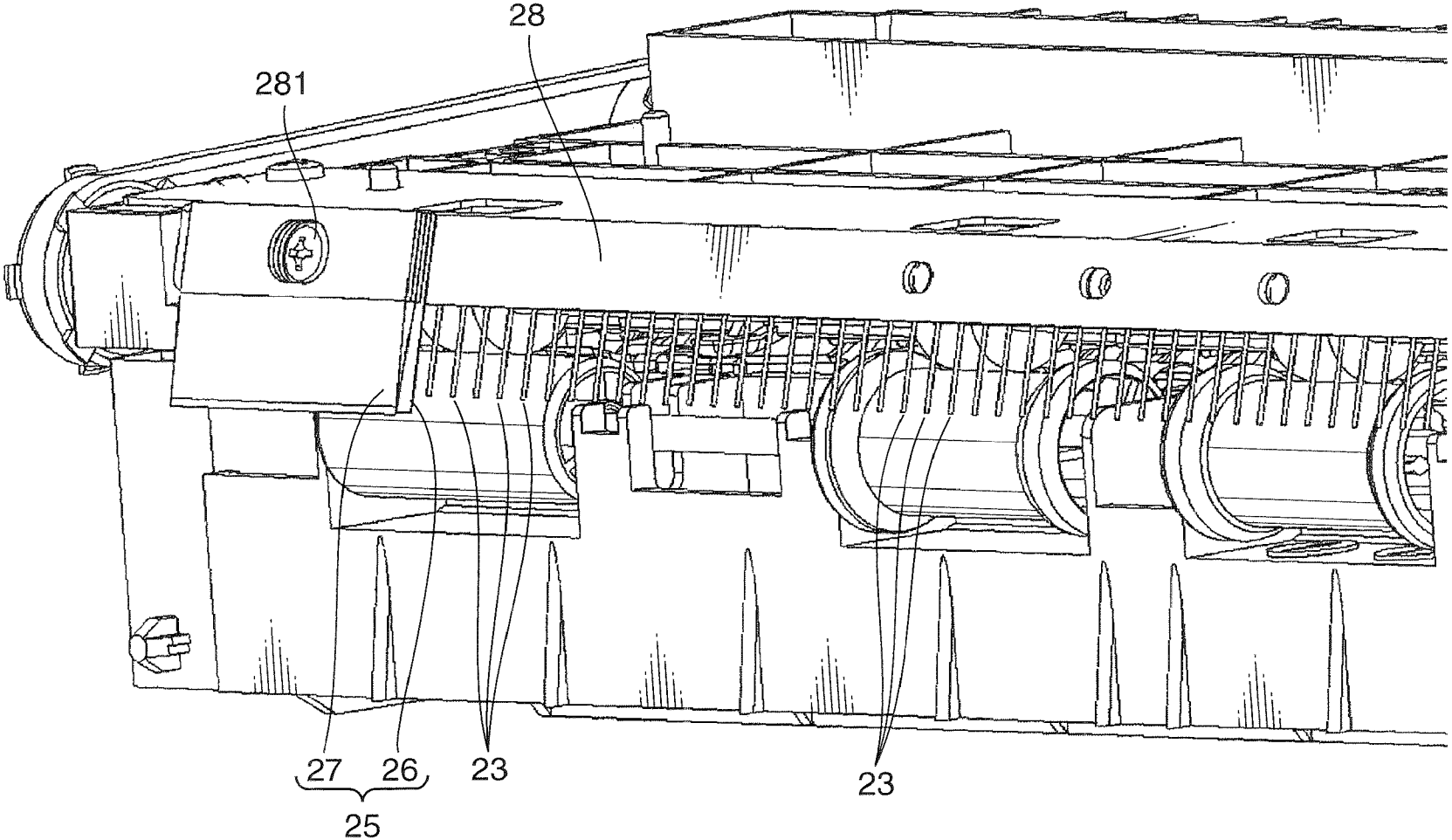
FIG. 7 is an enlarged view showing a left side end portion of FIG. 6.

FIG. 5 is a sectional view of the peripheral portion of the sheet-discharging rollers 16 and 17 in accordance with a second embodiment of the present invention. FIG. 6 is a perspective view of the sheet-discharging rollers 16 and 17 viewed from the sheet-discharging side. FIG. 7 is an enlarged view showing a left side end portion of FIG. 6. In these drawings, portions which are the same as those shown in FIGS. 1-4 are identified by the same reference signs, and description regarding these parts will be omitted or simplified.

In the second embodiment, an example is shown in which second flexible members 25 are arranged on a downstream side of the sheet-discharging rollers 16 and 17 in the sheet convey direction (forward conveyance). The second flexible members 25 orients the widthwise opposite end portions of the sheet P0 toward a central portion by contacting with opposite end portions of the sheet P0 which is discharged from the sheet-discharging rollers 16 and 17 toward the sheet-discharging tray 131 (outside) to stiffen the sheet P0. On the downstream side of the first and second sheet-discharging rollers 16 and 17, the above-described charge-removing brush 23 is provided. On a further downstream side of the charge-removing brush 23, the second flexible members 25 are provided.

When the sheet P0 is discharged to outside by the sheet-discharging rollers 16 and 17, the second flexible members 25 stiffen the sheet as described above. On the other hand, when the sheet P0 is switched back, a flexibility of the second flexible members 25 substantially makes the sheet P0 be less likely to be stiffened.

When the sheet P0 is discharged to the sheet-discharging tray 131, there is a case where a front end of the sheet P0 hangs down so that the sheet P0 is not discharged favorably onto the sheet-discharging tray 131. Therefore, when the sheet P0 is discharged to the sheet-discharging tray 131, it is preferable that the sheet P0 is stiffened by curving the same toward directions orthogonal to the conveying direction. On the other hand, at the time of the double-sided printing in which the switch-back conveyance is conducted, it is preferable that the sheet P0 is not stiffened so as to prevent jamming of a sheet. The second flexible member 25 meets such requests.

The second flexible members 25 are provided on widthwise opposite sides of the conveying passage 12C at the end portion 14 of the downstream side conveying passage 12C. Each flexible member 25 is a rectangular member and, in the present embodiment, includes a sheet piece 26 (first sheet piece) arranged on an upstream side and a V-shaped piece 27 (second sheet piece) arranged on a downstream side of the sheet piece 26 and bent to be V-shape in a side view. The sheet piece 26 is a synthetic resin sheet made of, for example, high-molecular polyethylene and is a member which is resistant against friction with the sheet P0. The V-shaped piece 27 is made of synthetic resins such as PET and formed to have a V-shape whose leading end is sharp so as to prevent catching of the sheet P0.

The second flexible member 25 is supported by the frame member 28 arranged above the first sheet-discharging roller 16. An upper end side of the second flexible member 25 having a rectangular shape is mounted to the frame member 28 with a screw, and its lower end side hangs forwardly from a sheet nip portion NP (refer to FIG. 5) between the sheet-discharging rollers 16 and 17. The leading end of the sheet piece 26 and the leading end of the V-shaped piece 27 are so set as to be at substantially the same position. Further, positions of the pair of second flexible members 25 are so set as to come in contact with the sheet P0 subjected to conveyance at opposite end portions where a sheet width of the conveying passage 12C in the width direction is minimum.

According to the image forming apparatus in accordance with the second embodiment, the second flexible members 25 are arranged on the downstream side of the sheet-discharging rollers 16 and 17. Therefore, the sheet P0 can be stiffened in a curved state by orienting the widthwise opposite end portions of the sheet P0 toward a central portion in the width direction. Further, since the second flexible members 25 are members having a flexibility, even if the sheet P0 is partially projected from the sheet-discharging rollers 16 and 17 and thereafter switched back at the time of performing the double-sided printing, the sheet P0 becomes unlikely to be stiffened. Further, since the second flexible member 25 is fixedly provided on a downstream side of the sheet-discharging rollers 16 and 17, it is not necessary to perform a control of rising and setting the stiffening member, and it is not necessary to provide a sensor. Accordingly, the cost can be reduced.

Further, as the second flexible members 25, a commercially available resin film can be used. Therefore, the apparatus can be easily produced. Further, the second flexible members 25 are provided on the downstream side from the charge-removing brush 23. Accordingly, the leading end of the sheet P0 supported by the sheet-discharging rollers 16 and 17 before performing the switch-back conveyance can fall into a state of not reaching the second flexible members 25 or a state where the stiffened distance is short even if reaching the second flexible members 25. Accordingly, the sheet P0 can be made less likely to be stiffened.

Third Embodiment

Figure 8:
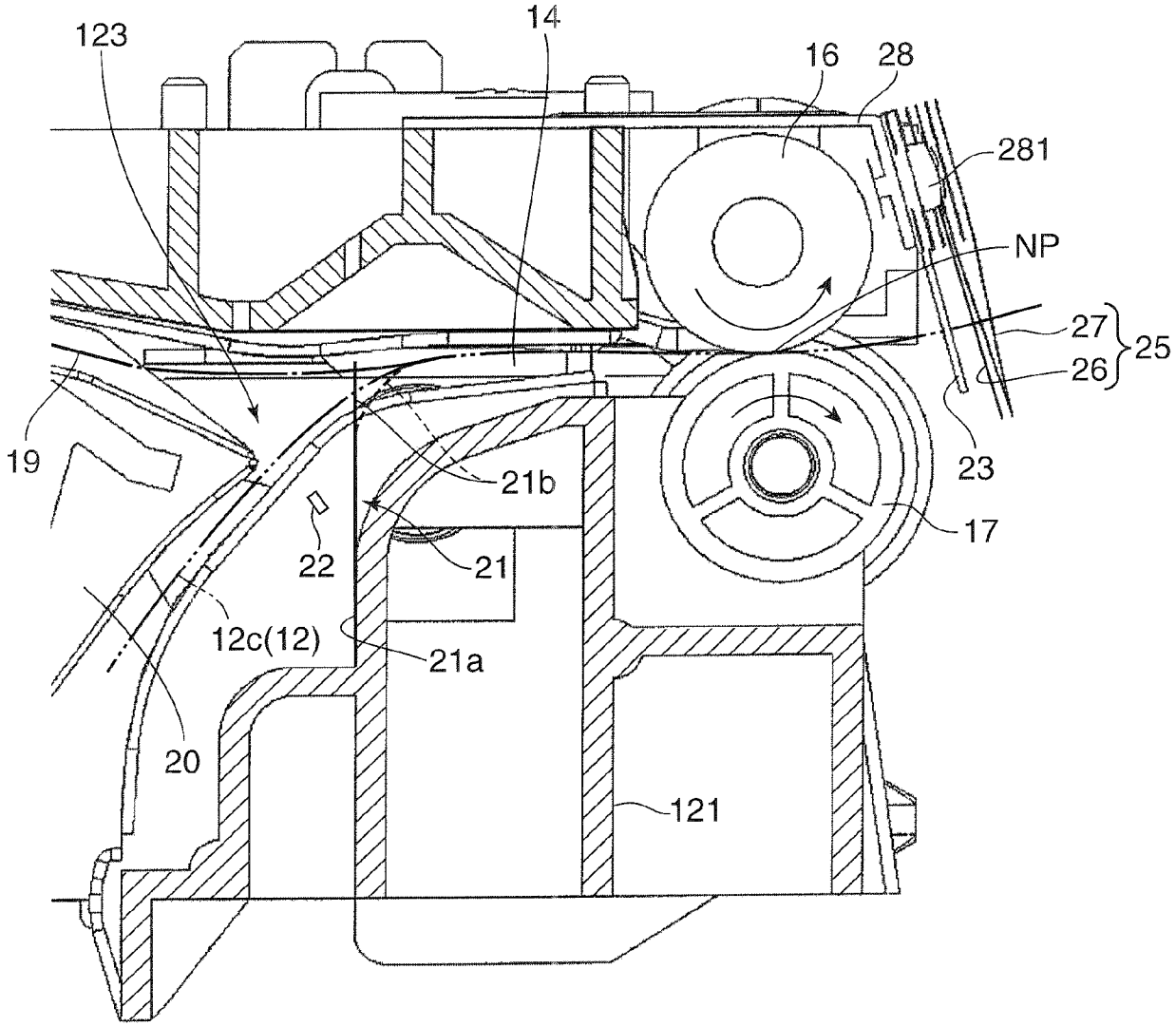
FIG. 8 is a sectional view of a peripheral portion of sheet-discharging rollers in accordance with a third embodiment of the present invention.
Figure 9:
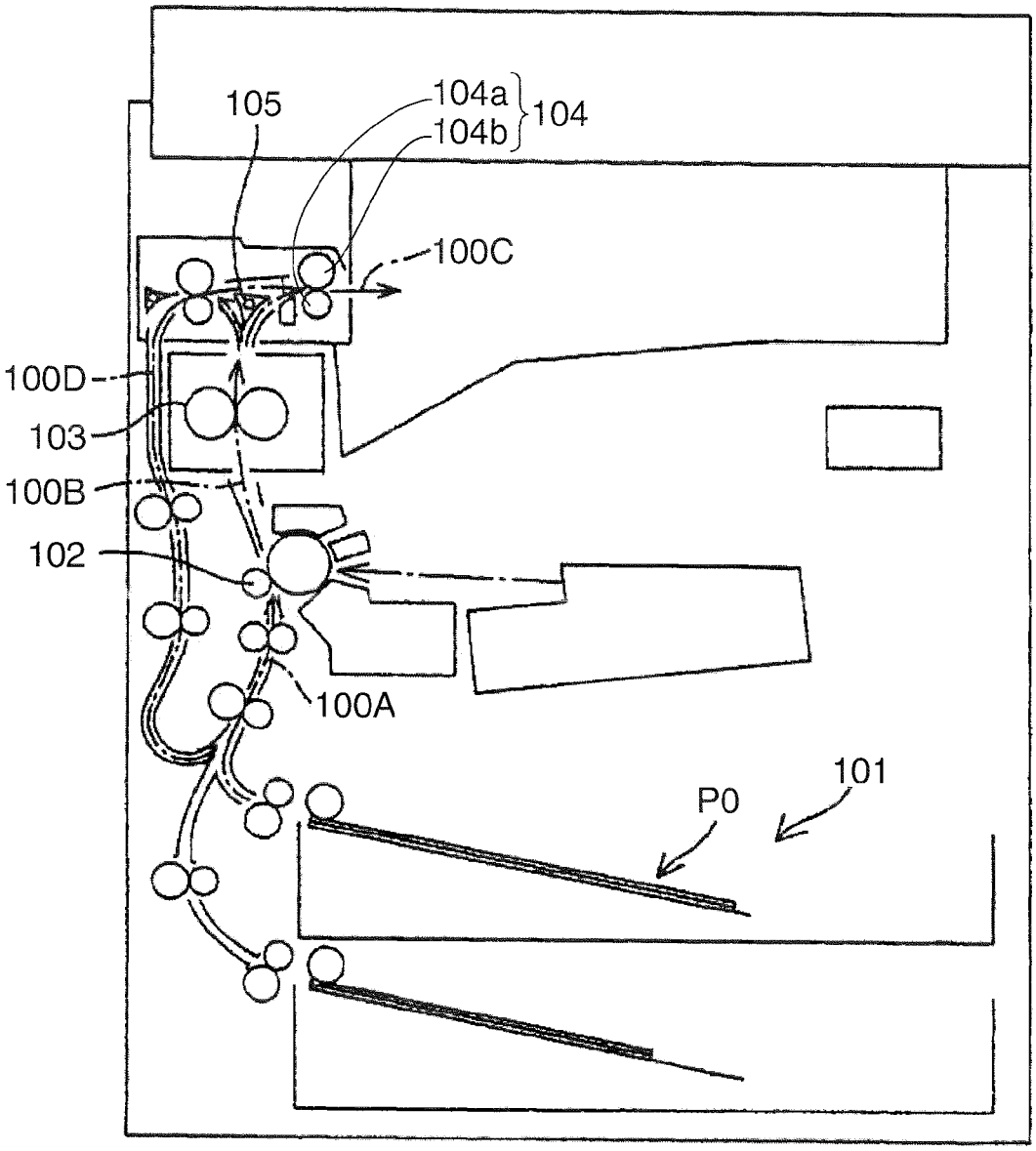
PRIOR ART FIG.9
FIG. 9 is a front sectional view of an image forming apparatus for explanation regarding a conventional technology.

FIG. 8 is a sectional view of the peripheral portion of the sheet-discharging rollers 16 and 17 in accordance with a third embodiment of the present invention. In the third embodiment, the first flexible members 21 in accordance with the first embodiment and the second flexible members 25 in accordance with the second embodiment are provided.

Configurations, arrangements, and functions of the first flexible members 21 and the second flexible members 25 are the same as those described above. The first flexible members 21 are arranged on the upstream side of the sheet-discharging rollers 16 and 17. When the sheet P0 is switched back, the first flexible members 21 come in contact with the underside surface of the sheet P0 to allow the sheet P0 to move to the inlet portion 19 of the reversing conveying passage 13 in a substantially horizontal posture. The second flexible members 25 are arranged on the downstream of the sheet-discharging rollers 16 and 17, and come in contact with widthwise opposite end portions of the sheet P0 discharged to outside from the sheet-discharging rollers 16 and 17, and make the widthwise opposite end portions of the sheet P0 to be oriented toward the central portion to stiffen the sheet P0.

According to the third embodiment, firstly, the first flexible members 21 are provided, so that when images are formed on opposite sides of the sheet P0, the upper portions 21*b* of the first flexible members 21 come in contact with the underside surface of the sheet P0 to push up the tailing end of the sheet in a state where the tailing end of the sheet P0 enters the posture changing passage 123 and conveyance is stopped. Accordingly, the sheet P0 is retained in a flat state, so that hanging of the tailing end of the sheet P0 can be prevented. Thus, the sheet P0 can assuredly be returned back to the inlet portion 19 of the reversing conveying passage 13 at the time of switching back, so that catching of the sheet P0 can be prevented.

Further, the second flexible members 25 are provided, so that the sheet P0 can be stiffened in a curved state by orienting the widthwise opposite end portions toward the central portion in the width direction. Since the second flexible members 25 which stiffen the sheet P0 are members having a flexibility, even if the sheet P0 is switched back after being partially projected from the sheet-discharging rollers 16 and 17 at the time of performing the double-sided printing, the sheet P0 is less likely to be stiffened.

In the above, some embodiments of the present invention are described. However, the present invention is not limited to those. For example, as an example of the assisting mechanism of the embodiment, the first flexible members 21 made of resin film are shown. However, the assisting mechanism may be a brush-like member, a slit film, or the like.

The embodiments described above mainly include the invention having the following configurations.

An image forming apparatus, comprising: an image forming section that forms an image onto a sheet; a first sheet conveying passage that conveys the sheet through the image forming section; a sheet-discharging roller provided on an outlet side of the first sheet conveying passage and capable of rotating in both normal and reverse directions; a second sheet conveying passage having an inlet side connected to the first sheet conveying passage on a downstream side in a sheet-conveying direction from the image forming section and having an outlet side connected to the first sheet conveying passage on an upstream side in the sheet-conveying direction from the image forming section; a controller that controls, at a timing of executing a double-sided printing, the sheet-discharging roller to rotate in normal directions to convey the sheet in a forward direction so as to put out a part of the sheet to outside from the sheet-discharging roller, and then to rotate in reverse directions to execute a switch back conveyance by which the sheet is transported to an inlet side of the second sheet conveying passage in order to return the sheet back to the upstream side of the image forming section; and an assisting mechanism that assists the switch back conveyance by adjusting a posture of the sheet.

According to this configuration, the assisting mechanism can adjust a posture of the sheet at the time of switching back. Accordingly, the sheet can be so postured that the sheet can be assuredly guided to the inlet side of the second sheet conveying passage. Thus, catching of the sheet can be prevented, and an assured switching back can be performed.

In the configuration above, it is preferable that the inlet side of the second sheet conveying passage is so positioned as to face to a sheet nip portion of the sheet-discharging roller along with a horizontal direction, the assisting mechanism is a first flexible member arranged on the upstream side from the sheet-discharging roller, and the first flexible member comes in contact with an underside surface of the sheet at least when the sheet is switched back, so as to allow the sheet to move toward the inlet side of the second sheet conveying passage in a substantially horizontal posture.

According to this configuration, at the time when the switching back is performed, the first flexible member comes in contact with the underside surface of the sheet to push up the tailing end of the sheet and retain the same in a flat state, so that the tailing end of the sheet is prevented from hanging. Accordingly, the sheet can assuredly be returned back to the inlet side of the second sheet conveying passage at the time of switching back, so that catching of the sheet can be prevented.

In the configuration above, it is preferable that the first sheet conveying passage includes a vertical conveying passage that conveys the sheet in an upward direction and a curved conveying passage which extends from a downstream of the vertical conveying passage to the sheet-discharging roller to change a conveying direction of the sheet from the upward direction to the horizontal direction and to convey the sheet in a curved state, while the inlet side of the second sheet conveying passage is so positioned as to face to the sheet nip portion of the sheet-discharging roller along with the horizontal direction, the assisting mechanism is a first flexible member which is arranged on an upstream side from the sheet-discharging roller so as to come in contact with the underside surface of the conveyed sheet, the first flexible member deforms so as to allow the sheet to fall in a curved state when the sheet is conveyed in the forward direction from the curved conveying passage to the sheet-discharging roller, and the first flexible member pushes up the sheet so as to allow the sheet to move toward the inlet side of the second sheet conveying passage in a substantially horizontal posture when the sheet is switched back.

According to this configuration, at the time of conveyance in the forward direction, the flexible member is flexibly deformed by the sheet conveyed through the curved conveying passage of the first sheet conveying passage. Accordingly, the sheet conveyance is permitted and not interfered. On the other hand, at the time of switching back, the first flexible member comes into contact with the underside surface of the sheet to push up the tailing end of the sheet and retain the sheet in a flat state, so that the tailing end of the sheet is prevented from hanging. Accordingly, the sheet can assuredly be returned back to the inlet side of the second sheet conveying passage at the time of performing switching back, so that catching of the sheet can be prevented.

In this case, it is preferable that the first flexible member is provided in a pair on widthwise opposite end portions of the curved conveying passage. According to this configuration, the tailing end of the sheet can be pushed up assuredly.

Further, it is preferable that there is further provided with a compartment member including a guide surface which constitutes a lower side of the curved conveying passage. The compartment member includes a mounting surface which is orthogonal to widthwise opposite end portions of the compartment member, while the first flexible member is a rectangular member having one end attached to the mounting surface and other end projecting upward beyond the guide surface. According to this configuration, arranging and mounting of the first flexible member can be performed extremely easily.

In the configuration above, it is preferable that the first flexible member includes a resin film. According to this configuration, a commercially available resin film can be used. Therefore, an inexpensive configuration can be made.

In the configuration above, it is preferable that there is further provided with a sensor that detects a tailing end of the sheet in the forward direction conveyance, and the controller controls normal and reverse rotations of the sheet-discharging roller in accordance with a detection signal of the sensor.

According to this configuration, for example, the point of time when the sheet changes from the curved state to the flat state can be detected. Thus, the sheet can assuredly be returned back to the second sheet conveying passage regardless of the sheet size.

In the configuration above, it is preferable that there is further provided with a second flexible member arranged on a downstream side of the sheet-discharging roller, and the second flexible member stiffens the sheet, which is discharged from the sheet-discharging roller to outside, by contacting with widthwise opposite end portions of the sheet so that the widthwise opposite end portions orient toward a central portion of the sheet. According to this configuration, the sheet which is discharged to outside from the sheet-discharging rollers is stiffened, so that a stable sheet-discharging can be performed.

In the configuration above, it is preferable that there is further provided with a second flexible member arranged on a downstream side of the sheet-discharging roller, and the second flexible member stiffens the sheet by contacting with widthwise opposite end portions of the sheet so that the widthwise opposite end portions orient toward a central portion of the sheet when the sheet is discharged to outside by the sheet-discharging roller, while making the sheet to be less likely to stiffen by a flexibility thereof when the sheet is switched back.

According to this configuration, the sheet can be stiffened in a curved state by orienting the widthwise opposite end portion of the sheet toward the central portion in the width direction. Since the second flexible member which stiffens the sheet is a member having a flexibility, even if the sheet is partially projected from the sheet-discharging rollers and switched back, the sheet becomes unlikely to be stiffened.

In the configuration above, it is preferable that there is further provided with a frame member arranged above the sheet-discharging roller, and the second flexible member includes rectangular members provided in a pair respectively on widthwise opposite end portions of the sheet-discharging roller, and each rectangular member has an upper end mounted to the frame member and a lower end hanging down on a front side of a sheet nip portion of the sheet-discharging roller. According to this configuration, arranging and mounting of the second flexible member can be performed extremely easily.

In this case, it is preferable that each second flexible member includes: a first sheet piece which is flat and arranged on an upstream side; and a second sheet piece which is arranged on a downstream side of the first sheet piece and is so bent as to have a V-shape cross section. According to this configuration, a second flexible member can be made which is resistant against friction with respect to the sheet and capable of suppressing catching of the sheet.

In the configuration above, it is preferable that there is further provided with a charge-removing member arranged on a downstream side of the sheet-discharging roller, and the second flexible member is arranged on a downstream side of the charge-removing member.

According to this configuration, the leading end of the sheet, which is supported by the sheet-discharging rollers before the switching back, can be made less unlikely to be stiffened by falling it into a state of not reaching the second flexible member or a state where the stiffened distance is short even if the case where the sheet reaches the second flexible member.

In the configuration above, it is preferable that the second flexible member is a resin film. According to this configuration, a commercially available film made of resin can be used. Accordingly, an inexpensive configuration can be made.

An image forming apparatus in accordance with another aspect of the present invention includes: an image forming section that forms an image onto a sheet; a first sheet conveying passage that conveys the sheet through the image forming section; a sheet-discharging roller provided on an outlet side of the first sheet conveying passage and capable of rotating in both normal and reverse directions; a second sheet conveying passage having an inlet side connected to the first sheet conveying passage on a downstream side in a sheet-conveying direction from the image forming section and having an outlet side connected to the first sheet conveying passage on an upstream side in the sheet-conveying direction from the image forming section; a controller that controls, at a timing of executing a double-sided printing, the sheet-discharging roller to rotate in normal directions to convey the sheet in a forward direction so as to put out a part of the sheet to outside from the sheet-discharging roller, and then to rotate in reverse directions to execute a switch back conveyance by which the sheet is transported to the inlet side of the second sheet conveying passage in order to return the sheet back to the upstream side of the image forming section; a first flexible member arranged on the upstream side of the sheet-discharging roller; and a second flexible member arranged on the downstream side of the sheet-discharging roller. The inlet side of the second sheet conveying passage is so positioned as to face to the nip of the sheet-discharging roller along with the horizontal direction, and the first flexible member comes in contact with an underside surface of the sheet at least when the sheet is switched back, so as to allow the sheet to move toward the inlet side of the second conveying passage in a substantially horizontal posture, and the second flexible member stiffens the sheet, which is discharged from the sheet-discharging roller to outside, by contacting with opposite end portions of the sheet so that the widthwise opposite end portions orient toward a central portion of the sheet.

In this case, it is preferable that the first sheet conveying passage includes: a vertical conveying passage that conveys the sheet in an upward direction; and a curved conveying passage which extends from a downstream of the vertical conveying passage to the sheet-discharging roller to change a conveying direction of the sheet from the upward direction to the horizontal direction and to convey the sheet in a curved state, while the inlet side of the second sheet conveying passage is so positioned as to face to the nip of the sheet-discharging roller along with the horizontal direction, the assisting mechanism is a first flexible member which is arranged on an upstream side from the sheet-discharging roller so as to come in contact with the underside surface of the conveyed sheet, the first flexible member deforms so as to allow the sheet to fall in a curved state when the sheet is conveyed in the forward direction from the curved conveying passage to the sheet-discharging roller, and the first flexible member pushes up the sheet so as to move toward the inlet side of the second sheet conveying passage in a substantially horizontal posture when the sheet is switched back.

Further, it is preferable that there is further provided with a frame member arranged above the sheet-discharging roller, and the second flexible member includes rectangular members provided in a pair respectively on widthwise opposite end portions of the sheet-discharging roller, and each rectangular member has an upper end mounted to the frame member and a lower end hanging down on a front side of a sheet nip portion of the sheet-discharging roller.

This application is based on Japanese Patent application serial Nos. 2007-284214 and 2007-283934 both filed in Japan Patent Office on Oct. 31, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image forming section that forms an image onto a sheet;

a first sheet conveying passage that conveys the sheet through said image forming section;

a sheet-discharging roller provided on an outlet side of said first sheet conveying passage and capable of rotating in both normal and reverse directions;

a second sheet conveying passage having an inlet side connected to said first sheet conveying passage on a downstream side in a sheet-conveying direction from said image forming section and having an outlet side connected to said first sheet conveying passage on an upstream side in the sheet-conveying direction from said image forming section;

a controller that controls, at a timing of executing a double-sided printing, said sheet-discharging roller to rotate in normal directions to convey the sheet in a forward direction so as to put out a part of the sheet to outside from said sheet-discharging roller, and then to rotate in reverse directions to execute a switch back conveyance by which the sheet is transported to an inlet side of said second sheet conveying passage in order to return the sheet back to the upstream side of said image forming section; and an assisting mechanism that assists the switch back conveyance by adjusting a posture of the sheet, wherein the inlet side of said second sheet conveying passage is so positioned as to face to a sheet nip portion of said sheet discharging roller along with a horizontal direction, said assisting mechanism is a first flexible member arranged on the upstream side from said sheet-discharging roller, and said first flexible member comes in contact with an underside surface of the sheet at least when the sheet is switched back, so as to allow the sheet to move toward the inlet side of said second sheet conveying passage in a substantially horizontal posture.

2. The image forming apparatus according to claim 1, wherein:

said first sheet conveying passage includes a vertical conveying passage that conveys the sheet in an upward direction and a curved conveying passage which extends from a downstream of said vertical conveying passage to said sheet-discharging roller to change a conveying direction of the sheet from the upward direction to the horizontal direction and to convey the sheet in a curved state;

the inlet side of said second sheet conveying passage is so positioned as to face to a sheet nip portion of said sheet-discharging roller along with the horizontal direction;

said assisting mechanism is a first flexible member which is arranged on an upstream side from said sheet-discharging roller so as to come in contact with the underside surface of the conveyed sheet;

said first flexible member deforms so as to allow the sheet to fall in a curved state when the sheet is conveyed in the forward direction from said curved conveying passage to said sheet-discharging roller; and said first flexible member pushes up the sheet so as to allow the sheet to move toward the inlet side of said second sheet conveying passage in a substantially horizontal posture when the sheet is switched back.

3. The image forming apparatus according to claim 2, wherein said first flexible member is provided in a pair on widthwise opposite end portions of said curved conveying passage.

4. The image forming apparatus according to claim 2, further comprising:

a compartment member including a guide surface which constitutes a lower side of said curved conveying passage, wherein said compartment member includes a mounting surface which is orthogonal to widthwise opposite end portions of said compartment member, and said first flexible member is a rectangular member having one end attached to said mounting surface and other end projecting upward beyond said guide surface.

5. The image forming apparatus according to claim 2, further comprising a sensor that detects a tailing end of the sheet in the forward direction conveyance, wherein said controller controls normal and reverse rotations of said sheet-discharging roller in accordance with a detection signal of said sensor.

6. The image forming apparatus according to claim 1, wherein said first flexible member includes a resin film.

7. The image forming apparatus according to claim 1, further comprising a second flexible member arranged on a downstream side of said sheet-discharging roller, wherein said second flexible member stiffens the sheet, which is discharged from said sheet-discharging roller to outside, by contacting with widthwise opposite end portions of the sheet so that the widthwise opposite end portions orient toward a central portion of the sheet.

8. The image forming apparatus according to claim 7, further comprising:

a frame member arranged above said sheet-discharging roller, wherein said second flexible member includes rectangular members provided in a pair respectively on widthwise opposite end portions of said sheet-discharging roller, and each rectangular member has an upper end mounted to said frame member and a lower end hanging down on a front side of a sheet nip portion of said sheet-discharging roller.

9. The image forming apparatus according to claim 8, wherein said second flexible member includes:

a first sheet piece which is flat and arranged on an upstream side; and a second sheet piece which is arranged on a downstream side of said first sheet piece and is so bent as to have a V-shape cross section.

10. The image forming apparatus according to claim 7, further comprising:

a charge-removing member arranged on a downstream side of said sheet-discharging roller, wherein said second flexible member is arranged on a downstream side of said charge-removing member.

11. The image forming apparatus according to claim 7, wherein said second flexible member is a resin film.

12. The image forming apparatus according to claim 1, further comprising:

a second flexible member arranged on a downstream side of said sheet-discharging roller, wherein said second flexible member stiffens the sheet by contacting with widthwise opposite end portions of the sheet so that the widthwise opposite end portions orient toward a central portion of the sheet when the sheet is discharged to outside by said sheet-discharging roller, while making the sheet to be less likely to stiffen by a flexibility thereof when the sheet is switched back.

13. An image forming apparatus, comprising:

an image forming section that forms an image onto a sheet;

a first sheet conveying passage that conveys the sheet through said image forming section;

a sheet-discharging roller provided on an outlet side of said first sheet conveying passage and capable of rotating in both normal and reverse directions;

a second sheet conveying passage having an inlet side connected to said first sheet conveying passage on a downstream side in a sheet-conveying direction from said image forming section and having an outlet side connected to said first sheet conveying passage on an upstream side in the sheet-conveying direction from said image forming section;

a controller that controls, at a timing of executing a double-sided printing, said sheet-discharging roller to rotate in normal directions to convey the sheet in a forward direction so as to put out a part of the sheet to outside from said sheet-discharging roller, and then to rotate in reverse directions to execute a switch back conveyance by which the sheet is transported to an inlet side of said second sheet conveying passage in order to return the sheet back to the upstream side of said image forming section;

a first flexible member arranged on the upstream side of said sheet-discharging roller; and a second flexible member arranged on the downstream side of said sheet-discharging roller, wherein:

the inlet side of said second sheet conveying passage is so positioned as to face to a sheet nip portion of said sheet-discharging roller along with the horizontal direction;

said first flexible member comes in contact with an underside surface of the sheet at least when the sheet is switched back, so as to allow the sheet to move toward the inlet side of the second conveying passage in a substantially horizontal posture; and said second flexible member stiffens the sheet, which is discharged from said sheet-discharging roller to outside, by contacting with widthwise opposite end portions of the sheet so that the widthwise opposite end portions orient toward a central portion of the sheet.

14. The image forming apparatus according to claim 13, wherein:

said first sheet conveying passage includes a vertical conveying passage that conveys the sheet in an upward direction, and a curved conveying passage which extends from a downstream of said vertical conveying passage to said sheet-discharging roller to change a conveying direction of the sheet from the upward direction to the horizontal direction and to convey the sheet in a curved state;

the inlet side of said second sheet conveying passage is so positioned as to face to a sheet nip portion of said sheet-discharging roller along with the horizontal direction;

said assisting mechanism is a first flexible member which is arranged on an upstream side from said sheet-discharging roller so as to come in contact with the underside surface of the conveyed sheet;

said first flexible member deforms so as to allow the sheet to fall in a curved state when the sheet is conveyed in the forward direction from said curved conveying passage to said sheet-discharging roller; and said first flexible member pushes up the sheet so as to allow the sheet to move toward the inlet side of said second sheet conveying passage in a substantially horizontal posture when the sheet is switched back.

15. An image forming apparatus according to claim 13, further comprising:

a frame member arranged above said sheet-discharging roller, wherein said second flexible member includes rectangular members provided in a pair respectively on widthwise opposite end portions of said sheet-discharging roller, and each rectangular member has an upper end mounted to said frame member and a lower end hanging down on a front side of a sheet nip portion of said sheet-discharging roller.

16. An image forming apparatus, comprising:

an image forming section that forms an image onto a sheet;

a first sheet conveying passage that conveys the sheet through said image forming section;

a sheet-discharging roller provided on an outlet side of said first sheet conveying passage and capable of rotating in both normal and reverse directions;

a second sheet conveying passage having an inlet side connected to said first sheet conveying passage on a downstream side in a sheet-conveying direction from said image forming section and having an outlet side connected to said first sheet conveying passage on an upstream side in the sheet-conveying direction from said image forming section;

a controller that controls, at a timing of executing a double sided printing, said sheet-discharging roller to rotate in normal directions to convey the sheet in a forward direction so as to put out a part of the sheet to outside from said sheet-discharging roller, and then to rotate in reverse directions to execute a switch back conveyance by which the sheet is transported to an inlet side of said second sheet conveying passage in order to return the sheet back to the upstream side of said image forming section;

an assisting mechanism that assists the switch back conveyance by adjusting a posture of the sheet; and a flexible member arranged on a downstream side of said sheet-discharging roller, wherein said flexible member stiffens the sheet, which is discharged from said sheet-discharging roller to outside, by contacting with widthwise opposite end portions of the sheet so that the widthwise opposite end portions orient toward a central portion of the sheet.

17. The image forming apparatus according to claim 16, further comprising:

a frame member arranged above said sheet-discharging roller, wherein said flexible member includes rectangular members provided in a pair respectively on widthwise opposite end portions of said sheet-discharging roller, and each rectangular member has an upper end mounted to said frame member and a lower end hanging down on a front side of a sheet nip portion of said sheet-discharging roller.

18. The image forming apparatus according to claim 17, wherein said second flexible member includes:

a first sheet piece which is flat and arranged on an upstream side; and a second sheet piece which is arranged on a downstream side of said first sheet piece and is so bent as to have a V-shape cross section.

19. The image forming apparatus according to claim 16, further comprising:

a charge-removing member arranged on a downstream side of said sheet-discharging roller, wherein said flexible member is arranged on a downstream side of said charge-removing member.

20. The image forming apparatus according to claim 16, wherein said flexible member is a resin film.

* * * * *